US008753093B2

(12) United States Patent
Liotta

(10) Patent No.: US 8,753,093 B2
(45) Date of Patent: Jun. 17, 2014

(54) BONDED TURBINE BUCKET TIP SHROUD AND RELATED METHOD

(75) Inventor: Gary Liotta, Greenville, SC (US)

(73) Assignee: General Electric Company, Schenectady, NY (US)

( * ) Notice: Subject to any disclaimer, the term of this patent is extended or adjusted under 35 U.S.C. 154(b) by 879 days.

(21) Appl. No.: 12/907,432

(22) Filed: Oct. 19, 2010

(65) Prior Publication Data

US 2012/0093634 A1 Apr. 19, 2012

(51) Int. Cl.
*F01D 5/20* (2006.01)

(52) U.S. Cl.
USPC ..... 416/241 R; 416/189; 415/173.1; 415/173.6

(58) Field of Classification Search
USPC ..... 415/173.1, 173.4, 174.4, 173.6; 416/189, 241 R; 29/889.1
See application file for complete search history.

(56) References Cited

U.S. PATENT DOCUMENTS

| | | | | |
|---|---|---|---|---|
| 4,285,108 | A * | 8/1981 | Arrigoni | 29/889.1 |
| 4,822,248 | A * | 4/1989 | Wertz et al. | 416/192 |
| 5,584,663 | A | 12/1996 | Schell et al. | |
| 6,468,040 | B1 | 10/2002 | Grylls et al. | |
| 6,616,410 | B2 | 9/2003 | Grylls et al. | |
| 6,811,379 | B2 | 11/2004 | Fernihough et al. | |
| 6,926,495 | B2 * | 8/2005 | Diakunchak | 415/173.3 |
| 6,994,920 | B2 | 2/2006 | Trewiler | |
| 7,771,171 | B2 | 8/2010 | Mohr et al. | |
| 8,021,120 | B2 * | 9/2011 | Schrey et al. | 416/224 |

* cited by examiner

*Primary Examiner* — Ninh H Nguyen
(74) *Attorney, Agent, or Firm* — Nixon & Vanderhye P.C.

(57) ABSTRACT

A turbine bucket includes an airfoil portion and a tip shroud at a radially outer end of the airfoil portion. The tip shroud includes a first radially inner tip shroud component formed integrally with the airfoil portion and composed of a first metal material, and a second radially outer structural tip shroud component composed of a second metal material bonded to the first radially inner tip shroud component.

18 Claims, 3 Drawing Sheets

BONDED TURBINE BUCKET TIP SHROUD AND RELATED METHOD

BACKGROUND OF THE INVENTION

This invention generally relates to turbine technology and, more specifically, to turbine buckets or blades formed with integral tip shrouds.

Tip shrouds located at the tips of turbine buckets or blades dampen vibrations and support the tip areas of the airfoil portions of the buckets. Tip shrouds also form the radially outer boundary of the hot gas flow path through the turbine stage. As such, tip shrouds span from one bucket to another and make contact at their oppositely-facing circumferential edges. Forward and aft edge portions of the tip shroud typically overhang the airfoil and it is these areas that are often exposed to higher temperatures and high bending stresses. These overhung areas can also creep, and even creep to rupture, before the useful service life of the entire bucket is consumed, thus limiting the life of the bucket.

Tip shrouds are often formed integrally with the bucket airfoil and may also support integral seal teeth designed to prevent hot gas leakage around the outer edges of the shrouds. The bucket or airfoil and tip shroud are usually formed by casting, and the tip shroud is typically machined to its final figuration.

The overhung forward and aft edge portions of the tip shrouds are often scalloped, removing overhung material, to reduce mass in these areas but this reduces the tip shroud outer flow path coverage, and thus reduces efficiency. In addition, the material for the bucket is generally selected as the lowest-temperature and lowest-cost alloy that can withstand the stresses and service life requirement for the airfoil portion.

It would therefore be desirable to provide a tip shroud configuration that is less prone to creep and thus more favorable in terms of meeting the predicted service life of the bucket.

BRIEF SUMMARY OF THE INVENTION

In accordance with a first exemplary but non-limiting embodiment, the invention provides a turbine bucket comprising an airfoil portion; and a tip shroud at a radially outer end of the airfoil portion including a first radially inner tip shroud component formed integrally with the airfoil and composed of a first metal material, and a second radially outer structural tip shroud component composed of a second metal material bonded to the inner tip shroud component.

In another exemplary but non-limiting aspect, the present invention provides a turbine bucket comprising an airfoil portion; and a tip shroud at a radially outer end of said airfoil portion, said tip shroud including a first radially inner component formed integrally with said airfoil and composed of a first metal material, and a second radially outer component composed of a one or more metal materials bonded together to form the second radial outer component, which is bonded to said first metal material, said second metal material made up of one or more components having a higher-temperature capability, and/or or a lower density than said first metal material.

In still another aspect, the present invention provides a method of forming an integral turbine bucket tip shroud comprising a) forming an airfoil portion of a turbine bucket with a first integral, radially inner tip shroud component; and b) bonding a second radially outer structural tip shroud component to said first integral, radially inner tip shroud component.

The invention will now be described in connection with the drawings identified below.

DETAILED DESCRIPTION OF THE INVENTION

Figure 1:
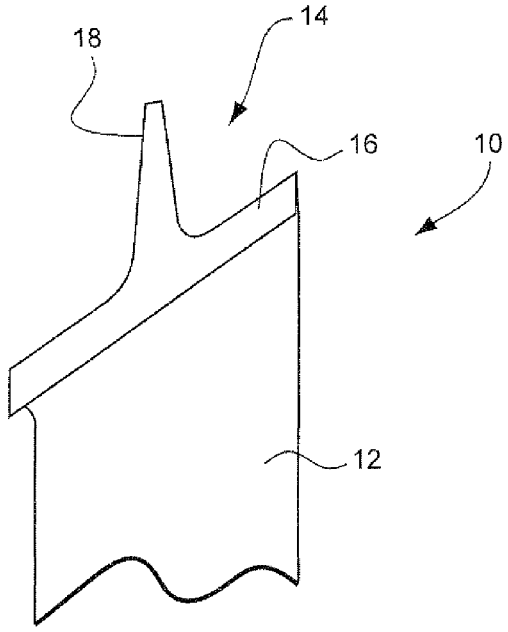
FIGS. 1, 2 and 3 illustrate side, top and circumferential views of a conventional turbine bucket tip shroud.
Figure 3:
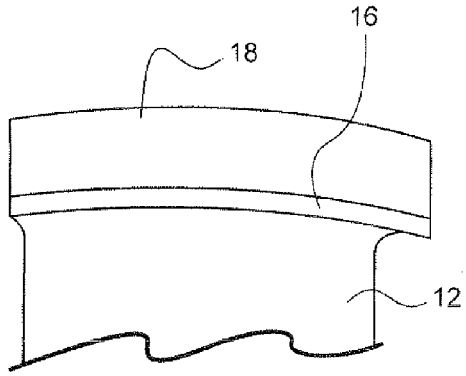
Figure 2:
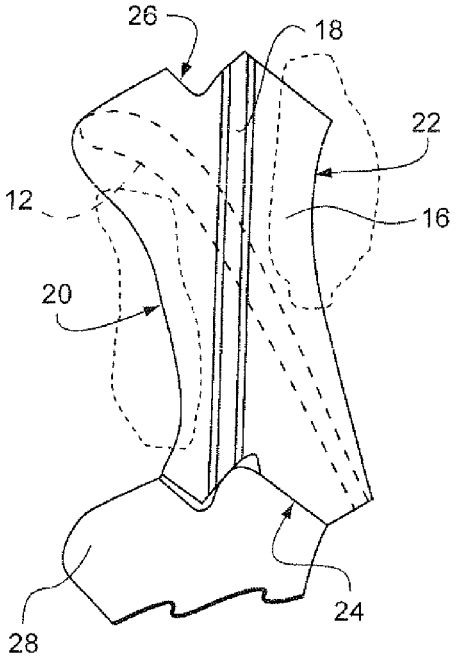

FIGS. 1-3 show a turbine bucket tip area 10 with an adjacent, radially inner airfoil portion 12 and an integral tip shroud 14. Shown are side, top and circumferential views of the integral tip shroud configuration. The tip shroud 14 includes a shroud proper or base 16 which, in turn, typically supports at least one upstanding or radially projecting seal tooth 18. In many instances, the shroud 14 is made integral with bucket airfoil 12. Typically, the bucket is cast and, after casting, the tip shroud is machined to its final shape. FIG. 2 shows lateral or side areas (also referred to as forward and aft edge portions) 20, 22 of the tip shroud 16 that overhang the airfoil 12, and it is these areas (encircled with dotted lines) that are prone to creep as a result of exposure to high temperatures and high bending stresses over time. Circumferential edges 24, 26 are shaped to engage similar edges on adjacent bucket tip shrouds (one shown at 28).

Figure 4:
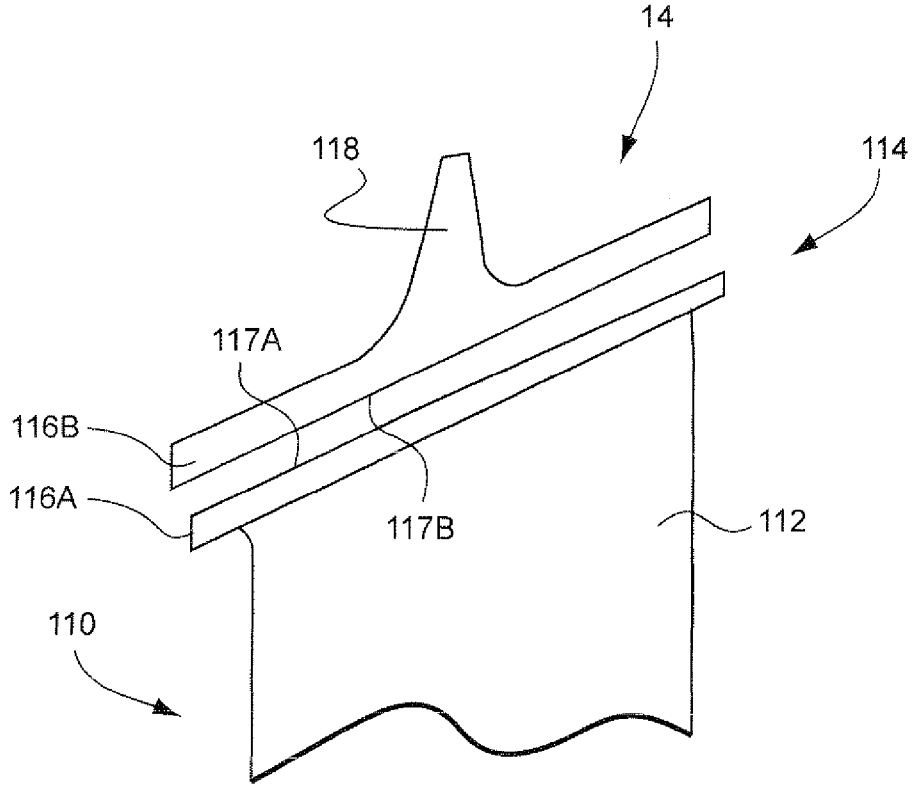
FIG. 4 is a partial exploded side view of bonded tip shroud in accordance with an exemplary but nonlimiting embodiment of the invention.
Figure 5:
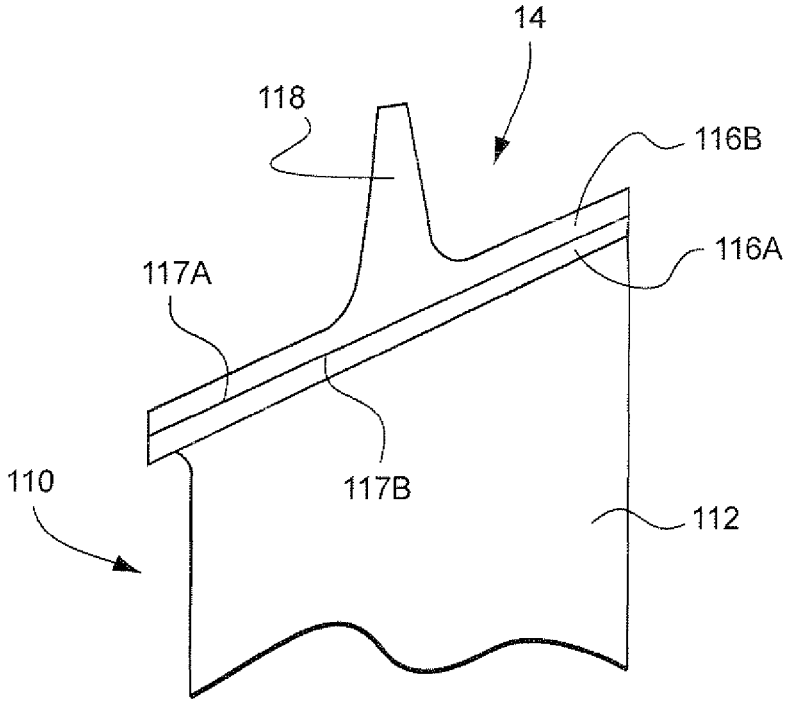
FIG. 5 is a partial side view similar to FIG. 4 but illustrating the upper tip shroud bonded to the lower tip shroud.
Figure 6:
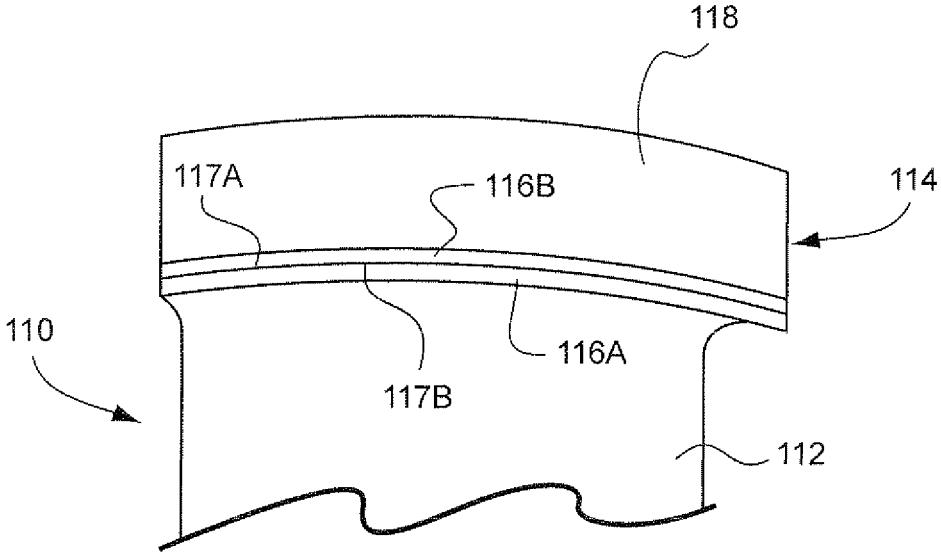
FIG. 6 is a partial circumferential view of the tip shroud shown in FIG. 5.

With reference now to FIGS. 4-6, a bonded, bi-metal tip shroud area 110 is illustrated in accordance with an exemplary but non-limiting embodiment of the invention. More specifically, the airfoil portion 112 includes a tip shroud 114 composed of radially inner and outer components 116A, 116B, with the inner component 116A formed integrally with the airfoil portion 112. The radially inner tip shroud component 116A may be composed of a typical bucket lower-temperature capable, equiaxed or directionally-solidified nickel-based, cobalt-based or other superalloy. The radially outer tip shroud component 116B is bonded to the radially inner tip shroud component 116A and is made from a higher temperature, more expensive alloy material and/or a lower density material. For example, a mono-crystal, nickel-based Rene N5 superalloy with temperature capability of 1400°-1800° or higher, and with a density similar to the less-expensive, nickel-based superalloy inner tip shroud component 116A, is suitable. An alternative approach is to use a lower density material, such as a foamed metal. The foamed metal could be the same Rene N5 material, optionally combined with a different and even higher-temperature alloy. The lesser density, foamed metal material is effective because it reduces stress such that the shroud tip can withstand higher temperatures. Thus, two exemplary techniques may be employed to reduce creep in the described two-component tip shroud: using a higher temperature-capable material in the radially outer tip shroud component; or, using a less dense material, such as a foamed metal, with or without a higher temperature capability material, in the radially outer tip shroud component.

In any case, it is to be understood that both components 116A and 116B are structural in nature, i.e., the inner component 116A is not merely clad or coated with another material. In fact, the outer component 116B adds strength to the tip shroud 114.

Pre-bonding treatment of the tip shroud component flat interface surfaces 117A, 117B may include surface roughening, nickel-flashing or other suitable techniques for enhancing the bonding between the tip shroud components. It will be understood, however, that one or both interface surfaces could be formed with a radial tab adapted to seat in one or more recesses in the respective opposed surface to resist shear along the bond line.

Once the inner and outer tip shroud components 116A and 116E are bonded together by, e.g., diffusion brazing, the outer, higher-temperature capable component 116B supports and strengthens the lower-temperature capable tip shroud component 116A, greatly increasing temperature and structural capability, and increasing the creep and, or low-cycle fatigue capability of the tip shroud. Diffusion brazing is beneficial because it offers bond-line strength close to the component parts themselves.

In the configuration where the outer tip shroud component 116B is made from a lower density material, it reduces pull or G forces on the lower tip shroud 116A and on the entire bucket. With this embodiment, the stress of the bucket airfoil is reduced and the service life improved. In addition, the tip shroud size in the overhung areas (20 and 22) can be increased to form a continuous circumferential surface only interrupted by the gaps between bucket tips. This improved coverage reduces tip losses, and improves tip clearance, increasing performance.

One or more shroud seal teeth 118 may be incorporated into the outer shroud component 116B, further improving tip shroud performance.

It will be appreciated that other bonding techniques may also be employed. Inspection of the bonded interface can be performed after finish-machining of the bonded tip shroud components. The bond line may be inspected for any possible voiding, while the inner bonded area, away from the outer surface bond line, can be non-destructively inspected by, for example, ultrasonic inspection or witness holes to ensure full bonding.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A turbine bucket comprising:

an airfoil portion; and a tip shroud at a radially outer end of said airfoil portion including a first radially inner tip shroud component formed integrally with said airfoil portion and composed of a first metal material, and a second radially outer structural tip shroud component composed of a second metal material bonded to said first radially inner tip shroud component, wherein said second metal material has a higher-temperature capability than said first metal material.

2. The turbine bucket of claim 1 wherein said first radially inner and second radially outer structural tip shroud components are bonded along facing, substantially flat surfaces.

3. The turbine bucket of claim 1 wherein said first radially inner and second radially outer structural tip shroud components are bonded along facing, contoured surfaces that enhance the bonding between the upper and lower parts.

4. The turbine bucket of claim 1 wherein said first metal material comprises a nickel or cobalt-based alloy.

5. The turbine bucket of claim 1 wherein said second metal material comprises a mono-crystal, nickel or cobalt-based.

6. The turbine bucket of claim 1 wherein said second metal material comprises a foamed, mono-crystal, nickel or cobalt-based superalloy.

7. The turbine bucket of claim 1 wherein opposite circumferential ends of said tip shroud are profiled for mating engagement with adjacent bucket tip shrouds on a turbine rotor wheel, and further wherein said second radially outer structural tip shroud component supports one or more seal teeth.

8. The turbine bucket of claim 1 wherein opposite forward and aft edge portions of said first radially inner and second radially outer structural tip shroud components are scalloped and overhang pressure and suction sides of said airfoil portion.

9. A turbine bucket comprising an airfoil portion; and a tip shroud at a radially outer end of said airfoil portion including a first radially inner tip shroud component formed integrally with said airfoil portion and composed of a first metal material, and a second radially outer structural tip shroud component composed of a second metal material bonded to said first radially inner tip shroud component; and wherein said second metal material has a lower density than said first metal material.

10. The turbine bucket of claim 9 wherein said second metal material has a higher-temperature capability than said first metal material.

11. The turbine bucket of claim 9 wherein said second metal material comprises a foamed metal.

12. A turbine bucket comprising:

an airfoil portion; and a tip shroud at a radially outer end of said airfoil portion, said tip shroud including a first radially inner component formed integrally with said airfoil portion and composed of a first metal material, and a second radially outer component composed of a one or more metal materials bonded together to form the second radial outer component, which is bonded to said first metal material, said second metal material made up of one or more components having a higher-temperature capability, and/or or a lower density than said first metal material.

13. The turbine bucket of claim 12 wherein said second metal material has a lower density than said first metal material.

14. The turbine bucket of claim 12 wherein said second metal material is foamed to produce said lower density.

15. The turbine bucket of claim 12 wherein said first radially inner and second radially outer tip shroud components of are bonded along facing, substantially flat surfaces, and wherein said second radially outer tip shroud component supports one or more seal teeth.

16. The turbine bucket of claim 12 wherein said first radially inner and second radially outer structural tip shroud components are bonded along facing, contoured surfaces that enhance the bonding between the upper and lower parts, and wherein said second radially outer tip shroud component supports one or more seal teeth.

17. The turbine bucket of claim 12 wherein opposite circumferential ends of said tip shroud are profiled for mating engagement with adjacent bucket tip shrouds on a turbine rotor wheel.

18. The turbine bucket of claim 12 wherein opposite forward and aft edge portions of said tip shroud including said first radially inner tip shroud component and said second radially outer tip shroud component are scalloped and overhang pressure and suction sides of said airfoil portion.

* * * * *

UNITED STATES PATENT AND TRADEMARK OFFICE

CERTIFICATE OF CORRECTION

PATENT NO. : 8,753,093 B2
APPLICATION NO. : 12/907432
DATED : June 17, 2014
INVENTOR(S) : Gary Charles Liotta It is certified that error appears in the above-identified patent and that said Letters Patent is hereby corrected as shown below:

In the Specification:

At column 3, line 10, change "116E" to --116B--

In the Claims:

In Claim 6 at column 4, line 2, delete "foamed," after --comprises a-- and before --mono-crystal--

Signed and Sealed this
Eighteenth Day of November, 2014

Michelle K. Lee

Michelle K. Lee
*Deputy Director of the United States Patent and Trademark Office*